United States Patent [19]

Thomas et al.

[11] 4,313,032

[45] Jan. 26, 1982

[54] FOLDED HORN LOUDSPEAKER SYSTEM

[75] Inventors: Donald W. Thomas; Stephen A. Stockton, both of Little Rock, Ark.

[73] Assignee: Invironments Inc., Little Rock, Ark.

[21] Appl. No.: 40,447

[22] Filed: May 18, 1979

[51] Int. Cl.[3] ..... H04R 1/30

[52] U.S. Cl. ..... 179/1 E; 181/152; 181/199

[58] Field of Search ..... 179/1 E, 115.5 H, 146 E; 181/152, 199, 189, 179, 153, 159

[56] References Cited

U.S. PATENT DOCUMENTS

| | | | |
|---|---|---|---|
| 1,407,574 | 2/1922 | Price | 181/177 |
| 4,138,594 | 2/1979 | Klipsch | 179/1 E |
| 4,174,019 | 11/1979 | Kramer | 181/159 |

FOREIGN PATENT DOCUMENTS

| | | | |
|---|---|---|---|
| 911982 | 4/1954 | Fed. Rep. of Germany | 181/177 |

OTHER PUBLICATIONS

"An Improved Corner Horn Speaker System", G. L. Augspurger, *Radio and Television News,* Feb. 1953, pp. 48 and 49.

*Primary Examiner*—Thomas W. Brown
*Attorney, Agent, or Firm*—Stephen D. Carver

[57] ABSTRACT

A folded-horn loudspeaker system adapted for high-power audio applications. The system preferably comprises a rigid enclosure of generally cubicle dimensions and an integral, exponentially curved horn projecting outwardly from the enclosure toward the listening area. A transducer housed within a sealed chamber interiorly of the enclosure communicates through an aperture into a waveguide system of substantially rectangular dimensions. A baffle plate system deflects sound energy from the waveguide into the throat of the horn. The baffle plate system is positioned to avoid the reflection of sound waves back into the waveguide to thereby minimize distortion.

2 Claims, 5 Drawing Figures

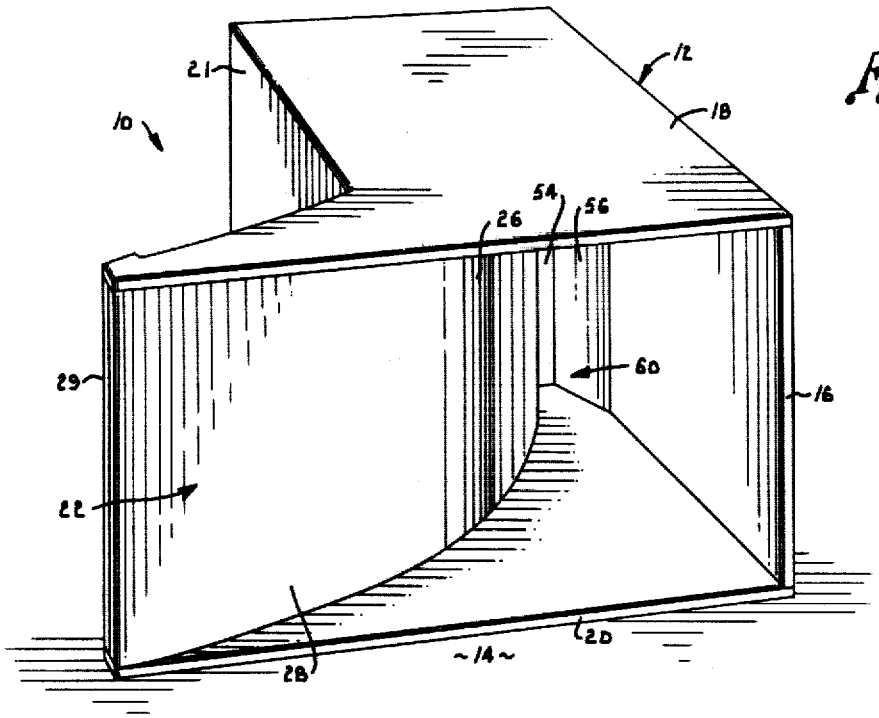
Fig. 1.
Fig. 2.
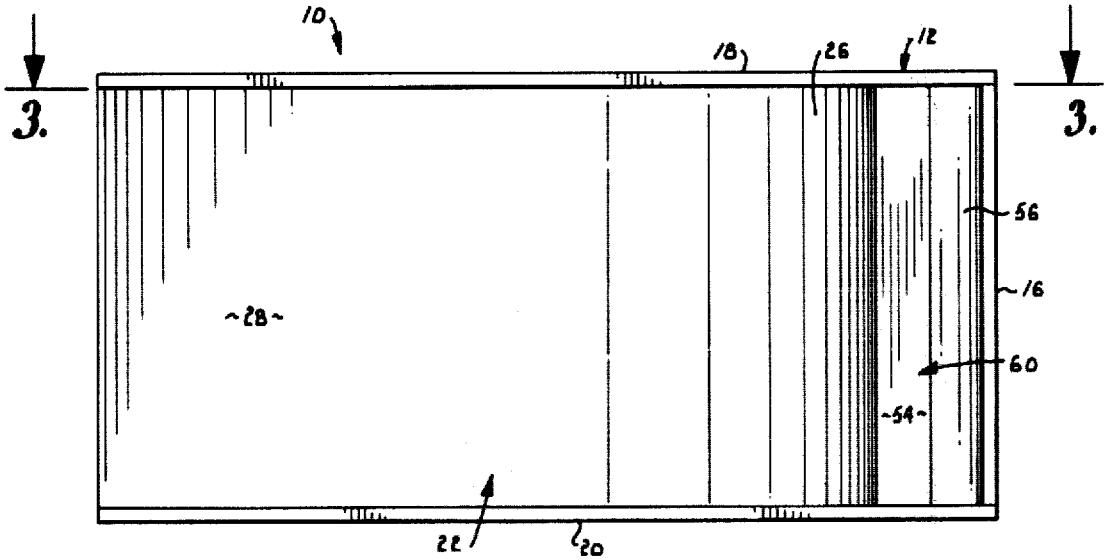

Fig. 3.
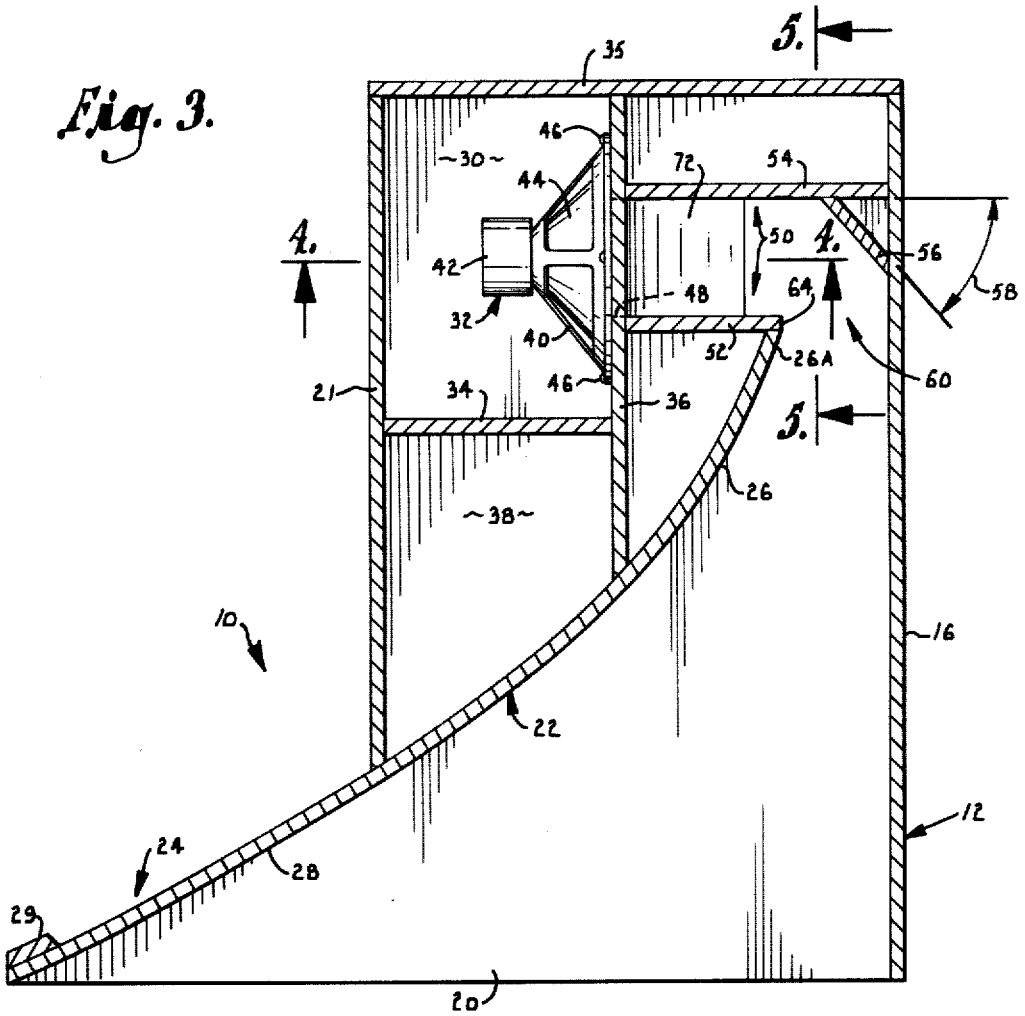
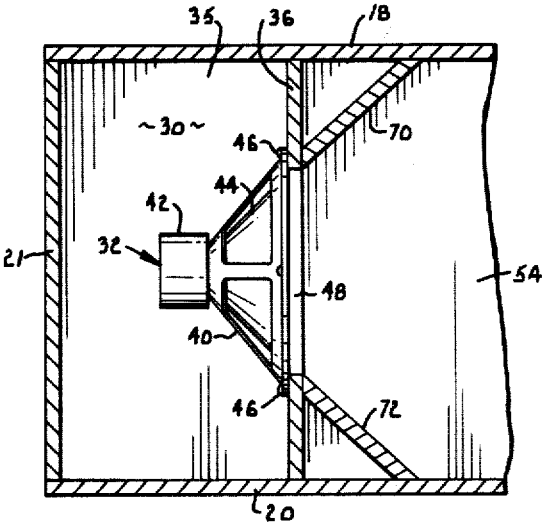
Fig. 4.
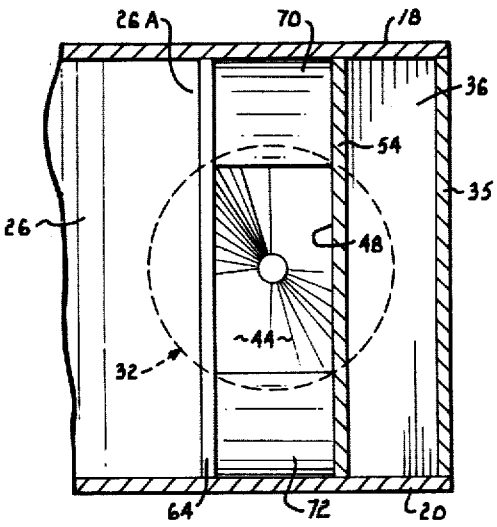
Fig. 5.

FOLDED HORN LOUDSPEAKER SYSTEM

BACKGROUND OF THE INVENTION

This invention relates to speaker systems. More particularly, the present invention relates to high power, folded-horn systems particularly adapted for use at discos and the like.

Horn loudspeaker systems have become well known in the prior art because of their high efficiency and high fidelity characteristics. Consequently, horn speaker systems can be advantageous at dance halls, discos or other auditoriums where large numbers of people are assembled. In horn speaker sytems direct radiator embodiments comprise a throat mounted transducer which directly feeds a horn. In a folded horn an elongated, curving sound path is provided within an enclosure, the dimensions of which are related to the relatively larger wave length of bass frequencies. Through the folded horn technique a relatively small speaker cabinet can generate significant bass response.

In the prior art a variety of folded horn speaker systems are known. For example, a folded horn system in which the sound path is curved 180° is shown in U.S. Pat. No. 2,801,703, issued to D. Martin Aug. 6, 1957. The latter reference discloses a transducer sealed within an internal compartment which directs sound into the throat of a twisted horn. Examples of other somewhat relevant horn or bass reflex speaker cabinets are shown in the U.S. Pat. Nos. 2,205,804; 2,815,087; 3,912,866; 2,815,086; and 2,871,971.

One problem experienced with prior art folded horn speaker cabinets concerns their characteristically significant distortion. We have determined that much of the distortion generated with prior art folded horn speaker systems results from the employment of parallel surfaces on opposite sides of a horn path which result in continued reflection and re-reflection of the sound to generate standing waves and distortions. Another problem with prior art folded horn systems is that they tend to be resonant at a characteristic frequency, which can result in damage to the speaker or transducer driver utilized within the apparatus.

SUMMARY OF THE INVENTION

The present invention comprises a folded horn speaker enclosure which may employ a sealed driver to feed an exponential horn within a rigid enclosure. The invention is characterized by extremely low distortion and extremely high power handling capabilities.

The invention preferably comprises a generally cubicle, rigid enclosure formed from a plurality of intersecting planes. A flared horn system is defined between one wall of the enclosure and a generally exponentially-shaped curved surface which originates within the enclosure and extends outwardly therefrom, defining and terminating in a sound projecting mouth. The mouth is of larger dimensions than the enclosure. A waveguide system of generally rectangular proportions is provided within the enclosure at right angles to the throat of the horn. A preferably sealed chamber is provided for housing a transducer driver. The chamber is acoustically coupled to the waveguide system through an aperture substantially similar to the shape of the waveguide. Sound thus directed into the waveguide system is reflected by a baffle plate system into the throat of the horn. Importantly, no two surfaces within the horn path, wherein the sound path is curved, are parallel, so that standing waves are not generated within the apparatus and distortion is minimized.

Thus an object of this invention is to provide a folded horn speaker system of extremely high power handling capabilities.

Still another object of this invention is to provide a durable, high performance speaker system ideally adapted for use in dance halls, auditoriums, discos and the like.

A still further object of this invention is to provide a low distortion speaker system of the character described. It is an important feature of this invention that the use of parallel surfaces on opposite sides of a folded horn path is avoided, so as to prevent the generation of standing waves.

Yet another object of this invention is to provide a primarily low frequency horn speaker system characterized by relatively wide frequency response.

A similar object of this invention is to provide a speaker system of the character described which does not generate as much distortion as prior art systems.

Another object is to provide a speaker enclosure which allows conventional driver transducers to be subjected to continuous high power levels.

A still further object of this invention is to provide a speaker system ideally adapted for faithfully reproducing the continuous, repetitive heavy bass which is characteristic of today's popular "disco" dance music.

These and other objects and advantages of this invention, along with features of novelty appurtenant thereto, will appear or become apparent in the course of the following detailed description.

BRIEF DESCRIPTION OF THE DRAWINGS

In the following drawings, which form a part of the specification and which are to be construed in conjunction therewith, and in which like reference numerals have been employed throughout to indicate like parts in the various views;

FIG. 1 is an isometric view of a folded horn speaker system constructed in accordance with the teachings of this invention;

FIG. 2 is an enlarged, front elevational view of the invention;

FIG. 3 is a sectional view of the invention taken through line 3—3 of FIG. 2, with parts thereof broken away or shown in section for clarity the speaker/transducer not shown in section;

FIG. 4 is a sectional view taken generally through line 4—4 of FIG. 3, with parts thereof omitted for brevity and with the speaker/transducer not shown in section; and FIG. 5 is a sectional view taken generally through line 5—5 of FIG. 3, with parts thereof broken away for brevity.

DETAILED DESCRIPTION OF THE INVENTION

Turning now to the drawings, the speaker system 10 comprising the present invention comprises a rigid, enclosure 12 of generally cubicle dimensions which may be supported on a surface 14 to direct sound toward the listener. The invention may alternatively be suspended in an out-of-the-way place from brackets or the like. Enclosure 12 comprises a first planner side 16 (FIG. 3) of generally rectangular dimensions which extends perpendicularly between enclosure top 18 and enclosure bottom 20. A second side 21 which also extends vertically perpendicularly between the top 18 and bottom 20 is of somewhat shorter dimensions lengthwise than side 16. Sides 16 and 22 are oriented substantially parallel, the distance therebetween comprising the width of the enclosure. It will be apparent that a horn structure 22 of preferably exponential shape originates within the enclosure 12 and curves outwardly therefrom.

Horn 22 is defined between a curved, rigid sheet 26 which extends perpendicularly between enclosure top 18 and bottom 20, and sidewall 16. The horn throat is defined between innermost portion 26A and the internal surface of wall 16. The outermost portion 28 thereof extends outwardly from enclosure 12, being reinforced in position between cabinet top 18 and bottom 20 by an elongated strip 29. The mouth of the horn is thus defined generally between strip 29 and the outermost end of sidewall 16. It will be readily apparent that portion 24 thereof extends out from the rest of the cabinet structure. Although curved sidewall 22 is preferably of the well known exponential shape, it may alternatively be formed from two planar surfaces which may intersect approximately at an angle of twenty-two degrees.

As best viewed in FIGS. 3 and 4, a substantially sealed chamber 30 is provided within enclosure 12 to house a driver or transducer 32 of conventional construction. Chamber 30 is defined between the rear portion of sidewall 21, a pair of spaced-apart, parallel planar surfaces 34 and 35 and a planar surface 36 oriented substantially perpendicularly to surfaces 34 and 35. It will be appreciated that each of the planar surfaces 34 through 36 extend generally perpendicularly within the enclosure between the top 18 and bottom 20 thereof, and may be secured thereto through a glueing or the like. The speaker or driver 32 is of conventional construction, comprising a rigid metallic frame 40, a conventional magnet 42, and a cone 44.

Speaker 32 is mounted flushly against panel 36 immediately adjacent to a generally rectangular aperture or slot 48 which communicates with a waveguide system 50 defined generally between planar waveguide surfaces 52 and 54. Surface 52 extends outwardly perpendiculary from planar surface 36 and terminates in a portion 64 which abuts horn portion 26A. The cooperating waveguide surface 54 extends perpendicularly away from surface 36 and abuts the enclosure wall 16 to seal the horn throat. A similar, generally planar baffle plate system 56 extends perpendicularly between top 18 and enclosure bottom 20. The baffle plate intersects plate 54 and sidewall 16, forming an angle 58 of substantially forty degrees with respect to the waveguide. In this manner acoustic energy travelling through the waveguide will be reflected into the horn throat, and re-reflection of energy back into the waveguide will be avoided.

As best viewed in FIGS. 3 and 5, panels 52 and 54 define an essentially rectangularly shaped waveguide into which sound is projected from speaker 32 via substantially rectangular slot 48. It will be appreciated that the width of slot 48 is substantially equal to the width of the waveguide system, corresponding to the distance between panels 52 and 54. The length or height of slot 48 is substantially equal to the diameter of speaker cone 44. Sound waves are thus "shaped" and projected into the waveguide system 50, reflected into horn throat 60 by the baffle system 56, and outputted from the enclosure. It will be appreciated that as sound propagates outwardly through the horn system no two surfaces therein are parallel so as to generate standing waves. For example, surface 26 contains no portions parallel with sidewall 16, which is substantially straight. The gradually expanding horn construction facilitates acoustic matching.

With reference now to FIG. 4, a pair of flared panels 70, 72 project upwardly and downwardly (as viewed in FIGS. 3, 4) from opposite ends of aperture 48 originating at panel 36. Panels 70, 72 flare away from aperture 48, respectively intersecting cabinet top 18 and bottom 20. The inclusion of flare panels 70, 72, combined with the fact that the width of aperture 48 is substantially equal to the width of the waveguide into which it communicates, further facilitates the low distortion generation of acoustic energy by the instant concept.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A folded horn loudspeaker system comprising:

rigid enclosure means comprising a substantially planar top, a substantially planar bottom spaced apart from said top, and a planar side extending between said top and said bottom and generally perpendicular with respect thereto;

flared horn means terminating in an open mouth for projecting sound from said enclosure means, said horn means defined between said planar side and a substantially exponentially-curved, rigid surface originating within said enclosure means and extending perpendicularly between said top and said bottom, said flared horn means including a throat positioned interiorly of said enclosure means;

substantially sealed chamber means defined interiorly of said enclosure means spaced apart from said horn means throat and including speaker transducer means for generating sound, said speaker comprising an aperture cone having a diameter;

substantially rectangular aperture means defined in said chamber means having an aperture width, and having a length substantially equal to said cone diameter;

waveguide means defined within said enclosure means substantially perpendicular to said side and said chamber means for conducting sound from said aperture means to said throat, said waveguide means having a width substantially equal to said aperture width; and planar baffle plate means for deflecting sound waves from said waveguide means into said horn means throat, said baffle plate means extending between said top and said bottom and between said waveguide means and said first side, said baffle means forming an angle of substantially forty degrees with respect to said waveguide means.

2. The combination as defined in claim 1 wherein said waveguide means comprises first and second substantially parallel, rigid planar plates within said enclosure means, said first plate extending between said chamber and said planar side, said second plate substantially shorter in length than said first plate and extending between said throat and said chamber, the width of said waveguide means corresponding to the distance between said first and second planar plates.

* * * * *